US008676107B2

(12) United States Patent
Okamoto et al.

(10) Patent No.: US 8,676,107 B2
(45) Date of Patent: Mar. 18, 2014

(54) LUBRICANT APPLYING DEVICE, PROCESS CARTRIDGE, AND IMAGE FORMING APPARATUS

(75) Inventors: Michiya Okamoto, Kanagawa (JP); Ken Amemiya, Tokyo (JP); Shinya Karasawa, Kanagawa (JP); Takuma Iwasaki, Kanagawa (JP); Satoshi Hatori, Kanagawa (JP); Toshio Koike, Tokyo (JP); Yuji Arai, Kanagawa (JP); Yuta Azeyanagi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 199 days.

(21) Appl. No.: 12/929,794

(22) Filed: Feb. 16, 2011

(65) Prior Publication Data

US 2011/0217101 A1 Sep. 8, 2011

(30) Foreign Application Priority Data

Mar. 2, 2010 (JP) ..... 2010-044869

(51) Int. Cl.
*G03G 21/00* (2006.01)

(52) U.S. Cl.
USPC ..... 399/346

(58) Field of Classification Search
USPC ..... 399/346; 184/14, 25, 3.2; 401/81
See application file for complete search history.

(56) References Cited

U.S. PATENT DOCUMENTS 6,558,862 B2 * 5/2003 Kojima et al. ..... 430/58.05
7,680,446 B2 3/2010 Shintani et al.
2007/0036595 A1 2/2007 Amemiya et al.
2007/0122217 A1 5/2007 Nagashima et al.
2007/0209877 A1 9/2007 Arai et al.
2008/0069614 A1 3/2008 Shintani et al.
2008/0069615 A1 3/2008 Shintani et al.
2009/0010693 A1 1/2009 Hatori et al.
2009/0032360 A1 * 2/2009 Asano ..... 192/87.13
2009/0103944 A1 4/2009 Shintani et al.
2009/0241830 A1 10/2009 Koike et al.
2009/0252510 A1 10/2009 Shintani et al.
2010/0021205 A1 1/2010 Honjoh et al.
2010/0106384 A1 * 4/2010 Mita et al. ..... 701/68

FOREIGN PATENT DOCUMENTS

JP 2581655 B2 11/1996
JP 2808118 B2 7/1998
JP 2000010448 A 1/2000
JP 2002244485 A 8/2002
JP 2005070276 A 3/2005
JP 2005-309119 A 11/2005
JP 2006-293262 A 10/2006

(Continued)

OTHER PUBLICATIONS

Machine translation of Kono JP 2007-322449.*

(Continued)

*Primary Examiner* — David Gray
*Assistant Examiner* — Sevan A Aydin
(74) *Attorney, Agent, or Firm* — Harness, Dickey & Pierce, P.L.C.

(57) ABSTRACT

A lubricant applying device includes a solid lubricant, and a rotatable applying member scraping lubricant off the solid lubricant and applying the scraped lubricant onto an application subject. In the lubricant applying device, a pressing unit applies that applies an applying pressure of pressing the solid lubricant against the applying member and that varies the applying pressure in accordance with a rotation speed of the applying member.

12 Claims, 11 Drawing Sheets

(56) References Cited

FOREIGN PATENT DOCUMENTS

| | | | |
|---|---|---|---|
| JP | 2007322449 | A | 12/2007 |
| JP | 2009008818 | A | 1/2009 |
| JP | 2009008819 | A | 1/2009 |
| JP | 2009063728 | A | 3/2009 |

OTHER PUBLICATIONS

Abstract of JP 04-282039 published on Oct. 7, 1992.
Abstract of JP 02-017239 published on Jan. 22, 1990.

* cited by examiner

LUBRICANT APPLYING DEVICE, PROCESS CARTRIDGE, AND IMAGE FORMING APPARATUS

CROSS-REFERENCE TO RELATED APPLICATIONS

The present application claims priority to and incorporates by reference the entire contents of Japanese Patent Application No. 2010-044869 filed in Japan on Mar. 2, 2010.

BACKGROUND OF THE INVENTION

1. Field of the Invention

The present invention relates to a lubricant applying device usable in electrophotography apparatuses such as copiers, printers, and facsimiles, a process cartridge configured to be replaced together with the lubricant applying device in a lump, and an image forming apparatus including them.

2. Description of the Related Art

An image forming unit of an electrophotography apparatus such as a copier needs to be equipped with a cleaning device for removing toner that is not transferred onto a transfer sheet but remains in a transfer process, or adherent substances that are present, on a photoreceptor or an image carrier called an intermediate transfer element. In general, a cleaning blade formed of an elastic body such as rubber is used as a cleaning means of the cleaning device and is in contact with the image carrier in the counter direction against the movement of the image carrier.

In addition, further provided is a mechanism that applies a lubricant such as zinc stearate onto the surface of the image carrier in order to maintain the surface friction coefficient of the image carrier at a desired value, thereby preventing an additive of the toner from sticking to the image carrier, or preventing the toner from being incompletely transferred onto the image carrier, which brings about toner residue on the image carrier, due to an increase in friction in the transfer process.

The lubricant applying mechanism scrapes a lubricant off a lubricant bar, which is in press-contact with the applying mechanism, with the use of a brush roller and adheres the lubricant attached to the brush roller onto the image carrier in the downstream of the transfer process. The lubricant attached to the image carrier is spread thin with the use of a cleaning blade which is in contact with the image carrier in the counter arranged in the further downstream side thereof, against the movement of the image carrier.

However, in regard with the application amount of lubricant applied onto the image carrier, an appropriate amount varies depending on the amount of toner developed on the image carrier. Therefore, for example, Japanese Patent Application Laid-open No. 2002-244485 discloses an image forming apparatus which includes a lubricant film-forming means and an image data counting means. The lubricant film-forming means attaches a solid lubricant to a rotating brush and applies the lubricant attached to the brush onto an image carrier, so that a film of the lubricant is formed on the surface of the image carrier. The image data counting means counts image formation information that is used to form an image on the image carrier. In the image forming apparatus, the amount of the lubricant to be applied onto the surface of the image carrier is controlled on the basis of the information from the image data counting means.

Further, Japanese Patent Application Laid-open No. 2009-008818 discloses a lubricant applying device including a holder and a rotating member. The holder holds a solid lubricant therein. The rotating member scrapes a lubricant off the solid lubricant held by the holder and applies it onto an image carrier. The lubricant applying device further includes a rotation speed control device that changes the rotation speed of the rotating member while images are being formed on the image carrier.

Furthermore, Japanese Patent Application Laid-open No. 2009-008819 discloses a lubricant applying device including a molded-lubricant holder that holds a molded-lubricant and applies the lubricant supplied from the molded-lubricant onto the surface of an image carrier. In the lubricant applying device, the molded-lubricant holder is configured to be replenished with a new molded-lubricant when the molded lubricant is consumed and thus becomes small.

Moreover, Japanese Patent Application Laid-open No. 2005-070276 discloses an image forming apparatus which includes an image carrier; a charging mechanism; an exposing mechanism; an developing mechanism and a cleaning mechanism, and the image forming apparatus including a transfer mechanism and a fixing mechanism. The image carrier is configured to carry a latent image thereon. The charging mechanism uniformly charges the surface of the image carrier. The exposing mechanism performs an exposure on the basis of image data so as to write a latent image on the charged surface of the image carrier. The developing mechanism supplies a toner to the latent image formed on the surface of the image carrier so as to turn the latent image into a visible image. The cleaning mechanism cleans the surface of the image carrier. The transfer mechanism transfers the visible image on the surface of the image carrier to a recording medium directly or via a process of transferring it to an intermediate transfer element. The fixing mechanism fixes the toner image on the recording medium. The image forming apparatus further includes an applying mechanism provided between the cleaning mechanism and the charging mechanism to apply a contained lubricant onto the image carrier with an applying blade, thereby forming a thin layer.

Also, Japanese Patent Application Laid-open No. 2007-322449 discloses a lubricant applying device applying a lubricant by pressing the lubricant against the surface of a rotating body. The lubricant applying device includes a rotatable shaft; a solid lubricant; and a driving mechanism. The rotatable shaft is provided substantially parallel to a rotating shaft of the rotating body. The solid lubricant is formed to have a substantially constant layer thickness, on a predetermined portion of the outer circumference of the shaft in the circumferential direction, and of which the leading end face in the rotating direction of the shaft acts as a pressed surface against the rotating body. The driving mechanism rotates the shaft in order to press the solid lubricant against the surface of the rotating body.

However, in Japanese Patent Application Laid-open No. 2002-244485, a change in application amount requires an extensive change of the apparatus such as a change in the rotation speed of the brush, so it is difficult to reduce the sizes of a lubricant applying mechanism and the image forming apparatus. Further, in Japanese Patent Application Laid-open No. 2009-008818, in order to make the rotation speed variable, a part such as an additional driver is required. Therefore, the number of parts increases and it incurs an increase production cost. In Japanese Patent Application Laid-open No. 2009-008819, the replenishment requires time and a technique and thus the solid lubricant replenishment is difficult. In Japanese Patent Application Laid-open No. 2005-070276, since there is only a little space to accommodate the solid lubricant in the apparatus, it is difficult to use the solid lubricant over a long period of time.

In Japanese Patent Application Laid-open No. 2007-322449, use of an electromagnetic clutch may enable the change in an applied pressure according to the rotation speed of an applying member. However, the electromagnetic clutch is expensive. Further, in Japanese Patent Application Laid-open No. 2007-322449, the movement of the applying member is little. Specifically, in the related art, the consumption of a lubricant is about 2 g per 1000 sheets, the consumed speed of the lubricant is 0.7 mm per 1000 sheets (on the assumption that the density of the lubricant is 1 g/cm$^3$ and the lubricant width is about the longitudinal width of A4 recording paper (295 mm)). Therefore, the applying member should be driven to move minutely. Since very little movement is necessary, the applying member should be discontinuously driven or a very large reduction of speed should be performed. In the case of driving the applying member discontinuously, the driving of the applying member is enabled by the driving of a photoreceptor. This leads to a fluctuation in load to the photoreceptor due to switching between the transmission and the cut-off of drive, which results in unevenness of the speed of the photoreceptor. It is problematic because unevenness of the speed may cause unevenness of a density in an image. Further, in the case of attempting to make a large reduction of speed, many gear trains or the like are necessary, and thus a large space is required for the applying mechanism.

SUMMARY OF THE INVENTION

It is an object of the present invention to at least partially solve the problems in the conventional technology.

According to an aspect of the present invention, there is provided a lubricant applying device including a solid lubricant; a rotatable applying member scraping lubricant off the solid lubricant and applying the scraped lubricant onto a lubricant application target, and a pressing unit that applies an applying pressure of pressing the solid lubricant against the applying member and that varies the applying pressure in accordance with a rotation speed of the applying member.

According to another aspect of the present invention, there is provided a process cartridge including: at least an image carrier carrying a latent image; and one or more units which are selected from the group consisting of a charging unit uniformly charging the surface of the image carrier, a developing unit supplying a toner to an electrostatic latent image formed on the surface of the image carrier to obtain a visible image, and a cleaning unit cleaning the surface of the image carrier; wherein the process cartridge integrally supported and integrally attachable to and detachable from an image forming apparatus, wherein the process cartridge includes lubricant applying device including: a solid lubricant; a rotatable applying member scraping lubricant off the solid lubricant and applying the scraped lubricant onto a lubricant application target, and a pressing unit that applies an applying pressure of pressing the solid lubricant against the applying member and that varies the applying pressure in accordance with a rotation speed of the applying member.

According to still another aspect of the present invention, there is provided an image forming apparatus including: an image carrier carrying a latent image; a charging device charging the image carrier; an exposing device exposing the image carrier to form an electrostatic latent image on the image carrier; a developing device forming a toner image on the image carrier; a transfer device transferring the toner image onto a recording medium directly or through an intermediate transfer medium; and a cleaning device removing a toner remaining on the image carrier after the transfer, wherein the image forming apparatus includes the lubricant applying device including: a solid lubricant; a rotatable applying member scraping lubricant off the solid lubricant and applying the scraped lubricant onto a lubricant application target, and a pressing unit that applies an applying pressure of pressing the solid lubricant against the applying member and that varies the applying pressure in accordance with a rotation speed of the applying member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, embodiments of the present invention will be described with reference to the drawings. Further, it is easy for those skilled in the art to achieve other embodiments by changing or modifying the embodiments of the present invention within the scope of claims, and these changes and modifications are included in the scope of the claims. The following description relates to examples of preferred embodiments of the present invention and is not intended to limit the scope of the claims.

Figure 1:
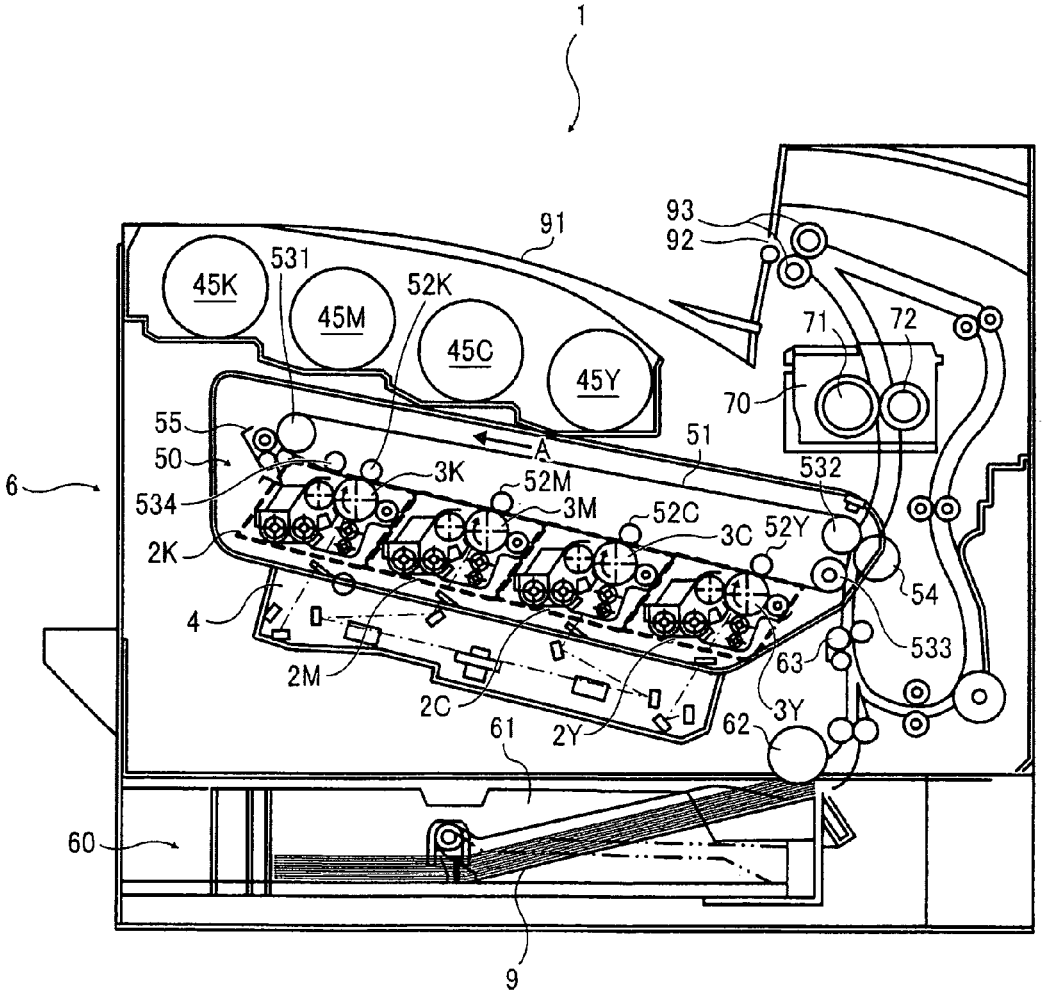
FIG. 1 is a view illustrating a configuration of an image forming apparatus with a lubricant applying device according to the present invention.

FIG. 1 is a view illustrating a configuration of an image forming apparatus with a lubricant applying device according to an embodiment of the present invention.

Here, an image forming apparatus 1 including a plurality of photoreceptors 3K, 3M, 3C, and 3Y will be described, but the present invention is not limited to the image forming apparatus 1 according to the embodiment. Further, here, a control is performed according to the toner amounts of the individual photoreceptors 3K, 3M, 3C, and 3Y, all of process cartridges 2 have the same form, and the configurations of them will be described without specifying any one of them.

The image forming apparatus 1 according to the embodiment of the present invention includes an image forming unit 6 disposed on the upper side and having a photoreceptors 3K, 3M, 3C, and 3Y serving as image carriers forming a toner image, and a feeding device 60 disposed on the lower side. In addition, on the upper side of the image forming unit, there is disposed a discharge tray 91 holding a recording member 9 having an image formed thereon.

At the center of the image forming apparatus 1, the image forming unit 6 is disposed. At the substantial center inside the image forming unit 6, four process cartridges 2K, 2M, 2C, and 2Y serving as imaging units are disposed in parallel to each other in a tandem type along a transfer device 50 correspond to individual color toners of yellow Y, magenta M, cyan C, and black K. In the transfer device 50, an intermediate transfer belt 51 is included. The intermediate transfer belt 51 is an endless belt of which the base is made of a heat-resistant material adjusted so as to have a middle resistance, such as polyimide or polyamide. The intermediate transfer belt 51 is wound on and supported by four rollers 531, 532, 533, and 534, and is driven to rotate in a direction of an arrow 'A' in FIG. 1.

Further, below the four process cartridges, there is provided an exposing device 4 exposing the surface of each of the charged photoreceptors on the basis of individual color image data so as to form latent images. At the positions opposite to the individual photoreceptors, with the intermediate transfer belt 51 therebetween, there are disposed primary transfer rollers 52K, 52M, 52C and 52Y serving as primary transfer devices which primarily transfer toner images formed on the photoreceptors 3K, 3M, 3C, and 3Y onto the intermediate transfer belt 51. The primary transfer rollers 52K, 52M, 52C and 52Y are connected to a power supply (not illustrated) and are supplied with a predetermined voltage.

A secondary transfer roller 54 as a secondary transfer device is in press contact with the outer surface of a portion of the intermediate transfer belt 51 supported by the support roller 532. The secondary transfer roller 54 is connected to the power supply (not illustrated) and is supplied with a predetermined voltage. The contact point between the secondary transfer roller 54 and the intermediate transfer belt 51 is a secondary transfer section where the toner image on the intermediate transfer belt 51 is transferred onto the recording member 9.

On the outside of a portion of the intermediate transfer belt 51 supported by the support roller 531, an intermediate transfer belt cleaning device 55 is disposed to clean the surface of the intermediate transfer belt 51 after a secondary transfer.

On the upper side of the secondary transfer section, a fixing device 70 is provided to semi-permanently fix the toner image on the recording member 9 to the recording member 9. The fixing device 70 includes a fixing roller 71, and a pressing roller 72. The pressing roller 72 faces and is in press contact with the fixing roller. A pressing roller 92 has a halogen heater inside thereof. In addition, instead of the fixing roller 71, although not illustrated, a heating roller having a halogen heater inside thereof and an endless fixing belt wound around a fixing roller may be used.

On the lower portion of the image forming apparatus, the feeding device 60 is provided so as to hold the recording member 9 and send the recording member 9 toward the secondary transfer section.

Figure 2:
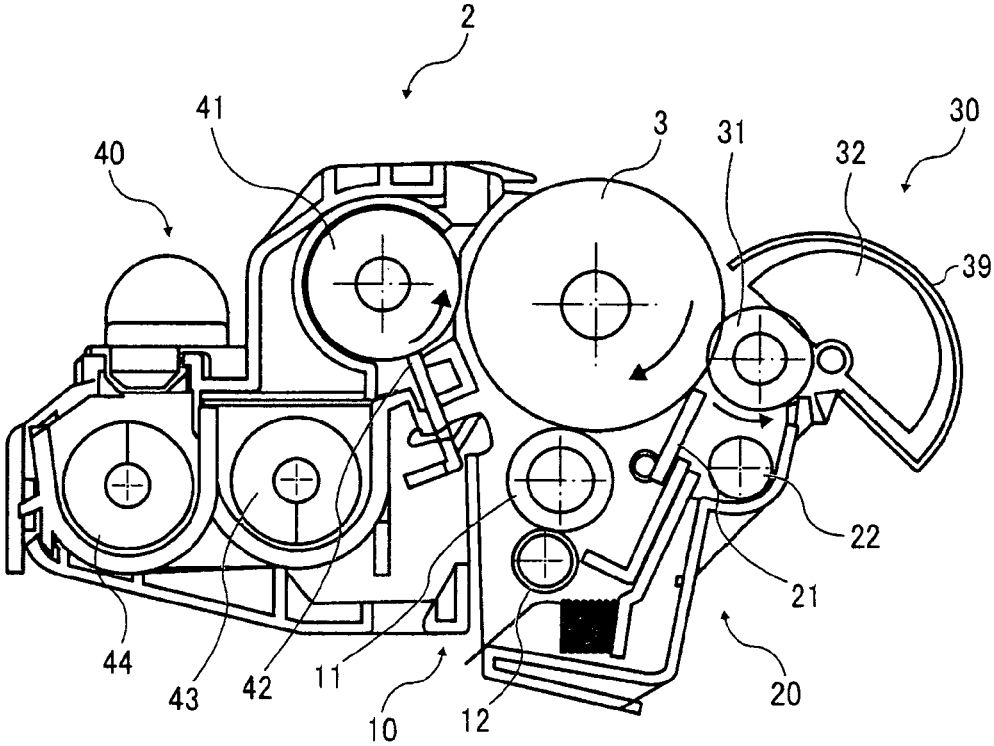
FIG. 2 is an enlarged schematic view illustrating a configuration of one of four process cartridges.

FIG. 2 is an enlarged schematic view illustrating a configuration of one of the four process cartridges. Since all of the process cartridges have the same configuration, in FIG. 2, signs of Y, M, C, and K for distinguishing colors from one another are omitted. Each process cartridge includes the photoreceptor 3. Around the photoreceptor 3, a charging device 10, a developing device 40, a lubricant applying device 30, and a cleaning device 20 are disposed, respectively. The charging device 10 applies an electric charge to the surface of the photoreceptor 3, and the developing device 40 develops the latent image formed thereon with each color toner to produce a toner image. The lubricant applying device 30 applies a solid lubricant 32 onto the surface of the photoreceptor 3, and the cleaning device 20 cleans the surface of the photoreceptor 3 after a toner image is transferred.

The individual elements illustrated in FIG. 2 may be discretely assembled in the main body of the image forming apparatus. In an example illustrated, the charging device 10 includes a charging roller 11, a charging-roller pressing spring (not illustrated), and a charging cleaner roller 12.

The lubricant applying device 30 includes a solid lubricant 32 and a brush roller 31 applying the lubricant.

The developing device 40 includes a development regulating member 42 regulating an amount of a developer on a developing sleeve 41, etc.

The cleaning device 20 includes a cleaning blade 21, and a waste-toner recovering roller 22.

FIG. 2 illustrates only one process cartridge 2. Each process cartridge 2 may integrally support any one or more of the photoreceptor 3, the charging device 10, the developing device 40, the cleaning device 20, and the lubricant applying device 30 and be attachable to and detachable from the image forming apparatus 1. It is preferable that each process cartridge 2 should include at least the photoreceptor 3 and the lubricant applying device 30. In the case of a process cartridge additionally including the charging device 10 and others, an imaging unit is integrated. Thus, a set property and a maintenance property are superior, and the accuracy of the positions of a developing member, a charging member, a cleaning member, etc. relative to a photoreceptor improves. Further, when they are configured in the form of a process cartridge, the replacement time of the photoreceptor 3 can be coincide with the replacement time of the lubricant applying device 30. Therefore, regarding the photoreceptor 3 and the lubricant applying device 30, the initial or time-dependent application conditions can be easily synchronized to always provide a stable quality. Furthermore, the maintenance and replacement of the imaging unit can also be very easily performed together.

Example of the photoreceptor 3 includes a photoreceptor 3 using a metal substance such as amorphous silicon, selenium, etc., or a photoreceptor 3 using an organic photosensitive substance. Here, the description is made with an organic photoreceptor. The photoreceptor 3 includes a resin layer having a filler distributed therein, a photosensitive layer including a charge generating layer and a charge transporting layer, and a protecting layer having a filler distributed to the surface thereof which are formed on a conductive support.

The photosensitive layer may be a single-layer photosensitive layer containing both of a charge generating substance and a charge transporting substance therein. However, a laminate of a charge generating layer and a charge transporting layer is advantageous over the single layer type in terms of sensitivity and durability.

The photosensitive layer is formed by distributing a pigment having a charge generating capability, together with a binder resin if necessary, in an appropriate solvent by using a ball mill, an attritor, a sand mill, an ultrasonic wave, or the like, applying it on the conductive support, and drying it. Examples of the binder resin include polyamide, polyurethane, epoxy resin, polyketone, polycarbonate, silicone resin, acrylic resin, polyvinyl butyral, polyvinyl formal, polyvinyl ketone, polystyrene, polysulfone, poly-N-vinylcarbazole, polyacrylamide, polyvinyl benzyl, polyester, phenoxy resin, vinyl chloride-vinyl acetate copolymer, polyvinyl acetate, polyphenylene oxide, polyamide, polyvinyl pyridine, cellulosic resin, casein, polyvinyl alcohol, polyvinyl pyrrolidone, etc. The appropriate amount of the binder resin is 0 to 500 parts by mass, preferably, 10 to 300 parts by mass, on the basis of 100 parts by mass of a charge generating substance.

Further, the charge transporting layer can be formed by dissolving or distributing a charge transporting substance and a binder resin in a solvent, applying it on the charge generating layer, and drying it. Examples of the charge transporting substance include a hole transporting substance and an electron transporting substance. Examples of the binder resin include thermoplastic or thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarate, phenoxy resin, polycarbonate, acetylcellulose resin, ethylcellulose resin, polyvinyl butyral, polyvinyl formal, polyvinyl toluene, poly-N-vinylcarbazole, acrylic resin, silicone resin, epoxy resin, melamine resin, urethane resin, phenol resin, alkyd resin, etc.

Furthermore, a protecting layer may be provided on the photosensitive layer. If a protecting layer is provided in order to improve durability, it may be possible to effectively use the photoreceptor 3 with high sensitivity but without abnormal defects according to the embodiment of the present invention.

Examples of the material of the protecting layer include resins such as ABS resin, ACS resin, olefin-vinyl monomer copolymer, chlorinated polyether, allyl resin, phenol resin, polyacetal, polyamide, polyamide-imide, polyacrylate, polyallylic sulfone, polybutylene, polybutylene terephthalate, polycarbonate, polyarylate, polyether sulfone, polyethylene, polyethylene terephthalate, polyimide, acrylic resin, polymethylpentene, polypropylene, polyvinylidene chloride, epoxy resin, etc. Among them, polycarbonate or polyarylate may be best used. In order to improve wear resistance, the protecting layer may additionally contain fluorine resin such as polytetrafluoroethylene, silicon resin, fluorine or silicone resin, each with an inorganic filler or an organic filler dispersed therein. Examples of the inorganic filler include titanium oxide, silver oxide, potassium titanate, silica, etc. The concentration of the filler in the protecting layer depends on the type of the filler or an electrophotography processing condition using the photoreceptor 3. On the outermost surface layer side of the protecting layer, a good ratio of the filler to the total solid content is 5% by mass or more, preferably 10% by mass or more and 50% by mass or less, and more preferably 30% by mass or less.

The charging device 10 uses a corotron type or scorotron type of discharging charger scheme. In the corotron type, a thin metal wire made of tungsten, molybdenum, or the like, with or without a metal plated on the surface thereof is constructed and stretched in an aluminum case. On the other hand, in the scorotron type, a metal wire to be a grid is constructed and stretched in an aluminum case. In addition, there is also a roller scheme in which a rotating roller is disposed being in contact with the photoreceptor or disposed facing the photoreceptor with a small gap not to contact with the photoreceptor. Any scheme may be used.

As the charging member, there is provided the charging roller 11 which is composed of a conductive core bar and an intermediate-resistant elastic layer covering the outside of the conductive core bar. The charging roller 11 is connected to the power supply (not illustrated) and is supplied with a predetermined voltage. The charging roller 11 is disposed being in contact with the photoreceptor 3. Although it is in contact with the photoreceptor 3, the circular cross-section of the charging roller 11 has a portion proximity to the photoreceptor 3. In the portion proximity to the photoreceptor 3, discharge occurs, charging the photoreceptor 3. In the embodiment of present invention, there is mounted the contact charging roller 12 in contact with the surface of the charging roller 11 to clean the surface of the charging roller 11. This reduces an amount of ozone generated and accordingly satisfies current needs considering the environment.

The charging roller has a structure including an axial section of a metal core bar disposed at the center, a resistance adjusting layer on the outside of the axial section, and a surface layer disposed as the outermost layer. For example, the axial section may be made of a metal such as stainless, or aluminum having high rigidity and conductivity to have a diameter of 8 mm to 20 mm or a conductive resin having high rigidity and of $1\times10^{3}\Omega\cdot$cm or less, preferably, $1\times10^{2}\Omega\cdot$cm or less. It is preferable that the resistant adjusting layer should have a volume resistivity of $1\times10^{5}\Omega\cdot$cm to $1\times10^{9}\Omega\cdot$cm, and a thickness of 1 mm to 2 mm. It is preferable that the surface layer should have a volume resistivity of $1\times10^{6}\Omega\cdot$cm to $1\times10^{12}\Omega\cdot$cm, and a thickness of about 10 μm. Here, the charging roller 11 having a double layer structure of the resistance adjusting layer and the surface layer has been described. However, the charging roller 11 is not limited particularly to the described structure but may have a single-layer structure or a three-layer structure.

The charging roller 11 is connected to the power supply, and is supplied with the predetermined voltage. The voltage may be only a direct current (DC) voltage. However, it is preferable that the voltage should be a voltage where an alternating current (AC) voltage is superimposed on a DC voltage. By applying the AC voltage, it may be possible to charge the surface of the photoreceptor drum more uniformly. In this embodiment, an AC voltage is superimposed on a DC voltage. Since the charging roller 11 is brought into contact with the photoreceptor 3 and charges the photoreceptor 3, the contact-type charging device 10 has the following and other advantages as compared with a corona charging scheme used in the related art. This is advantageous in that an amount of discharge products is extremely small. It is further advantageous in that since the applied voltage is low, the cost of the power supply is low. Moreover, it is yet further advantageous in that it is easy to create a design for electrical insulation. It is sure to reduce the problem caused by ozone, nitrogen oxides, etc.

Further, the charging roller 11 may be disposed with a minute gap from the photoreceptor drum. The minute gap can be set by winding a spacer member having a given thickness on non-image forming regions of both end portions of the charging roller 11 and bringing the surface of the spacer member to the surface of the photoreceptor drum.

The minute gap may be provided by the spacer member in such a manner that the charging roller 11 is disposed without contact with the photoreceptor 3. In this case, a film is wound as a spacer on the both end portions of the charging roller 11. The spacer is brought into contact with a photosensitive surface of the photoreceptor 3 so as to achieve a given minute gap between the charging roller 11 and an image forming region of the photoreceptor 3. When the bias voltage to be applied, the voltage, where an AC voltage is superimposed, is applied, discharge occurs in the minute gap between the charging roller 11 and the photoreceptor 3, thereby charging the photoreceptor 3. Further, the accuracy of maintenance of the minute gap is improved by pressing the axial section with a spring or the like.

Further, the spacer member and the charging roller 11 may be molded as one body. In this case, at least the surface of a gap portion is formed of an insulator. Therefore, discharge in the gap portion is prevented and thus a discharge product is prevented from being deposited on the gap portion so that the toner is not fixed to the gap portion by the adherence property of the discharge product. As a result, the gap is prevented from being widened.

In the developing device 40, the developing sleeve 41 with a magnetic field generating unit (not illustrated) disposed therein is disposed at a position facing the photoreceptor 3. Below the developing sleeve 41, two stirring/conveying screws 43 and 44 are provided and have a mechanism which mixes the toner injected from a toner bottle (not illustrated) with a developer and scoops up the mixture to the developing sleeve under stirring and mixing. The developer formed of a magnetic carrier and a toner conveyed by the developing sleeve 41 is regulated to a predetermined thickness of a developer layer by the regulating member 42, and is carried on the developing sleeve 41. The developing sleeve 41 carries the developer while moving in the same direction as the photoreceptor 3 at the position facing the photoreceptor 3, and supplies the toner to a latent image surface of the photoreceptor 3.

Further, as illustrated in FIG. 1, individual color toner cartridges 45Y, 45C, 45M, and 45K containing unused toners are detachably held in a space on the upper side of the photoreceptors 3. If necessary, the toners may be supplied to the individual developing device 40 by a toner conveying unit such as a mono pump or an air pump (not illustrated). The toner cartridge 45K for highly consumable black toner may particularly have a large capacity.

The cleaning device 20 may include a mechanism in which the cleaning blade 21 comes into contact with or separates from the photoreceptor 3 so that it can be arbitrarily brought into contact with or separated from the photoreceptor 3 by a controller of the main body of the image forming apparatus. The cleaning blade 21 may be formed of rubber such as urethane rubber, silicon rubber, or the like in a plate shape. The cleaning blade 21 is installed in a manner that the edge thereof is in contact with the surface of the photoreceptor 3, and it removes the toner remaining on the photoreceptor 3 after a transfer.

The cleaning blade 21 is formed of a metal, plastic, ceramic, or the like. The base end portion of the cleaning blade 21 is stuck and supported on a supporting member 25 fixedly supported by a housing of the cleaning device. The cleaning blade 21 is installed in a counter manner at a predetermined angle to the surface of the photoreceptor 3. The cleaning blade 21 is brought into contact with the photoreceptor 3 to remove the toner remaining on the photoreceptor 3. It also removes additives from the recording member 9, such as talc, kaolin and calcium carbonate, sticking on the photoreceptor 3 as contaminants, thereby performing cleaning. The removed toner and others are conveyed to a waste toner container (not illustrated) by the waste-toner recovering roller 22 and is stored in the waste toner container.

As illustrated in FIG. 2, the lubricant applying device 30 includes the solid lubricant 32 held in a fixed case 39, and the brush roller 31 serving as an applying member. The brush roller 31 is brought into contact with the solid lubricant 32, thereby scraping some lubricant off the solid lubricant and applying the lubricant onto the photoreceptor 3. Although not illustrated, the lubricant applying device 30 may additionally include a lubricant applying blade uniformizing the lubricant applied by the brush roller 31. The lubricant applying blade may be brought into contact with the surface of the photoreceptor at the downstream side, in the movement direction, with respect to the lubricant application position by the brush roller 31. The lubricant applying blade is formed of rubber which is an elastic body, and it is preferable that the lubricant applying blade should be in contact with the photoreceptor 3 in a trailing direction to the direction of the movement of the photoreceptor 3.

It is preferable that the thickness of brush fiber of the brush roller 31, which is brought into contact with the solid lubricant 32 to scrape some lubricant and apply the lubricant onto the photoreceptor 3, should be 3 deniers to 8 deniers, and it is preferable that the density of the brush fiber should be 20000 pieces/inch$^2$ to 100000 pieces/inch$^2$. If the thickness of the brush fiber is too small, falling of bristles of the brush roller 31 easily occurs when the brush roller 31 is brought into contact with the surface of the photoreceptor 3. Conversely, if the brush fiber is too thick, it may be impossible to increase the density of the bristles. Further, if the density of the brush fibers is low, since the number of fibers of the brush is small, it may be impossible to uniformly apply the lubricant. Conversely, if the density of the brush fibers is too high, gaps between the fibers are too small to scrape a sufficient amount of lubricant powder off, resulting in insufficiency of an application amount. For these reasons, the thickness and density of the brush fiber are set to the above-mentioned ranges, so that the falling of the bristles is not likely to occur and a uniform application of the lubricant may be efficiently performed.

Also, the lubricant of the image forming apparatus 1 contains a fatty acid metal salt.

Since the fatty acid metal salt prevents the surface of the photoreceptor 3 from being damaged by charging current and a lubrication action is maintained by the inorganic lubricant which is not damaged by the charging current, the cleaning of the photoreceptor 3 can be maintained well.

Examples of the fatty acid metal salt includes barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, magnesium palmitate, aluminum palmitate, calcium palmitate, lead caprylate, lead caprate, zinc linolenate, cobalt linolenate, calcium linolenate, zinc ricinoleate, cadmium ricinoleate, mixtures thereof, but are not limited thereto. Also, mixtures of them may be used. In the embodiment of the present invention, zinc stearate is particularly preferable to use in terms of a film-forming property onto photoreceptor.

Figure 3:
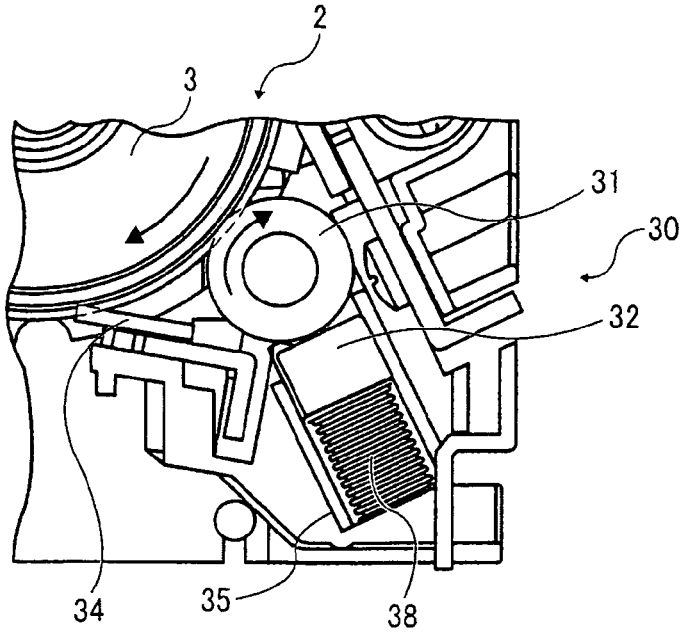
FIG. 3 is a view illustrating a configuration of a lubricant applying device according to the related art.

FIG. 3 is a view illustrating a configuration of a lubricant applying device according to the related art.

In the lubricant applying device 30, the solid lubricant 32 is formed in a rectangular parallelepiped shape and is pressed against the brush roller 31 by a pressing spring 38. The brush roller 31 scrapes off the solid lubricant 32 such that the solid lubricant 32 is consumed and decreases in thickness with time. Since the solid lubricant 32 is pressed by the pressing spring 38, it is always in contact with the brush roller 31. The brush roller 31 applies the scraped lubricant onto the surface of the photoreceptor 3 while it is rotating. The application amount of the lubricant applied onto the photoreceptor 3 is adjusted by the rotation speed of the brush roller 31. As the rotation speed increases, the amount of lubricant that is scraped off the solid lubricant 32 increases and thus the application amount of lubricant that is applied onto the photoreceptor 3 increases. Conversely, as the rotation speed decreases, the amount of lubricant that is scraped off the solid lubricant 32 decreases and thus the application amount of lubricant that is applied onto the photoreceptor 3 decreases.

As described above, in the related art, the solid lubricant 32 is guided by the case 39 as illustrated in FIG. 3. In other words, in addition to the brush roller 31 which is the applying member, portions being in contact with the solid lubricant 32 exist. However, since the solid lubricant 32 is hard and brittle, there is likelihood that clipping or cracks occur by the contact with the case 39. If the cracks occur, fragments generated at this time may enter the process cartridge 2, causing damage to the process cartridge or generating an abnormal image. In addition, the occurrence of cracks also degrades the application performance at the cracked portion, thereby causing an application error, which results in an abnormal image.

However, in the lubricant applying device according to the embodiment of the present invention, as illustrated in FIG. 2, since both ends of a core bar 321 are rotatably fixed and the core bar 321 is pressed against the brush roller 31 by an applied torque, there is no contact portion other than the brush roller 31 and thus clipping or cracks do not occur, thereby generating no fragments which may enter the process cartridge 2 to be a cause of damage or abnormal image generation and thereby generating no cracked portions which may degrade the application performance to cause an application error resulting in an abnormal image.

Figure 4A:
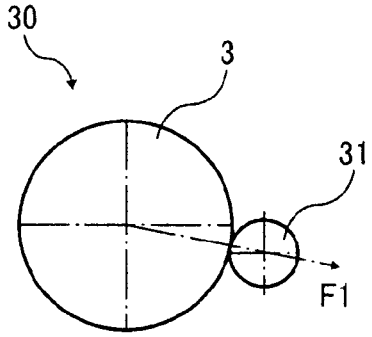
FIGS. 4A to 4C are views illustrating a configuration of a photoreceptor and the lubricant applying device according to the related art.
Figure 4B:
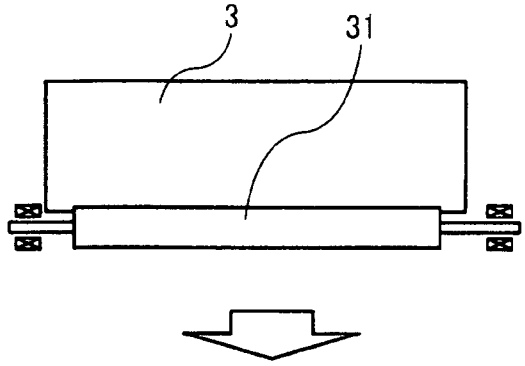
Figure 4C:
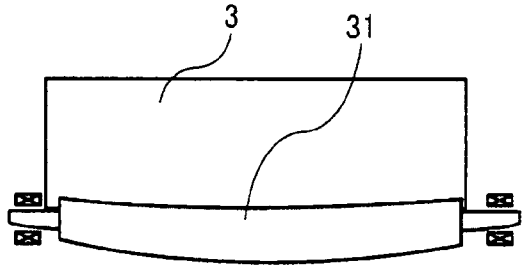

FIGS. 4A to 4C are views illustrating a configuration of a photoreceptor and the lubricant applying device according to the related art.

As illustrated in FIG. 4A, the brush roller 31 serving as the applying member is used in a state in which the brush roller 31 is bitten at the photoreceptor 3, and the scraped lubricant is applied onto the photoreceptor 3 by the brush roller 31. Therefore, a reaction force F1 from the photoreceptor 3 to the brush roller 31 acts. With the progress in miniaturization of the image forming apparatus 1 and the lubricant applying device 30, the diameter of the brush roller 31 has also decreased. For this reason, as illustrated in FIG. 4B, the rigidity of the brush roller 31 in the longitudinal direction is reduced. Therefore, when the reaction force F1 caused by biting of the brush roller 31 at the photoreceptor 3 is small, the brush roller 31 can be brought into uniform contact with the photoreceptor 3 and uniformly apply the lubricant. However, when the reaction force F1 is large, as illustrated in FIG. 4C, since the brush roller 31 is flexed, that the contact state of the brush roller 31 with the photoreceptor 3 is nonuniform and therefore the applied state of the lubricant is nonuniform.

Figure 5:
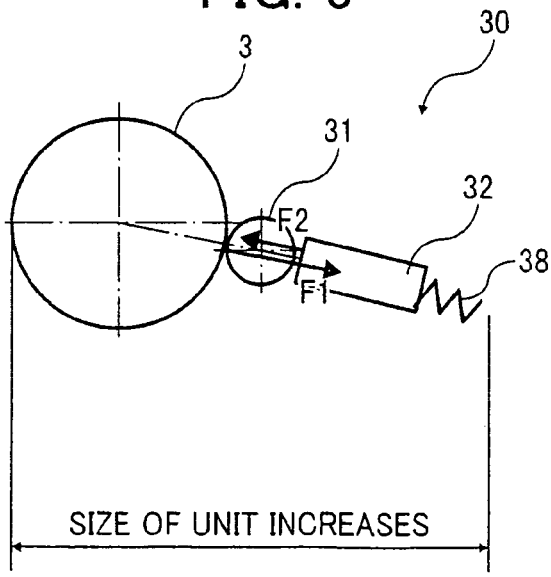
FIG. 5 is a view schematically illustrating exerting forces in the configuration of the lubricant applying device according to the related art.

FIG. 5 is a view schematically illustrating exerting forces in the configuration of the lubricant applying device according to the related art.

Here, a flexure of the brush roller 31 may be reduced to some extent by disposing the solid lubricant 32 on an extended line connecting between the center of the photoreceptor 3 and the center of the brush roller 31 and pressing the solid lubricant 32 with a reaction force F2 from the back of the solid lubricant 32 to the brush roller 31 by the pressing spring 38. However, the solid lubricant 32 having the rectangular parallelepiped shape according to related art increases the size of the lubricant applying device 30.

As illustrated in FIG. 5, the solid lubricant 32 is pressed against the brush roller 31 by the pressing spring 38, and therefore the lubricant is scraped off the solid lubricant 32 by the brush roller 31, and the lubricant adhering to the brush roller 31 is applied onto the photoreceptor 3.

Since the solid lubricant 32 has the rectangular parallelepiped shape, it is required to largely extend the solid lubricant 32 to the opposite side of the brush roller 31 with respect to the photoreceptor 3 in order to extend the use time of the solid lubricant 32.

Further, the rotation of the brush roller 31 is generally driven by a driving force transmitted by a gear provided to a flange (not illustrated) press fitted into the photoreceptor 3 and a gear attached to an end portion of the brush roller which are engaged with each other directly or through an idler gear. This configuration is frequently used since an additional driving unit for driving the brush roller is unnecessary and the brush roller can be driven with the use of minimum components.

There is a merit capable of reducing the number of components, but the rotation speed of the brush roller 31 depends on the rotation speed of the photoreceptor 3. Therefore, if the rotation speed of the photoreceptor 3 decreases, the rotation speed of the brush roller 31 also decreases.

It is known that there is a cardboard mode in which printing is performed at a relatively low linear speed. Therefore, in the same image forming apparatus 1, the photoreceptor 3 has some rotation speeds, that is, the photoreceptor 3 has some linear speeds, and is controlled according to a linear speed corresponding to each mode. Therefore, the photoreceptor 3 has some controllable linear speeds, and it is preferable to apply the same amount of lubricant per traveling distance of the photoreceptor 3 according to the rotation speeds corresponding to the individual linear speeds. However, actually, if the rotation speed of the brush roller 31 decreases, a scraping force scraping off the solid lubricant 32 also decreases.

Figure 6:
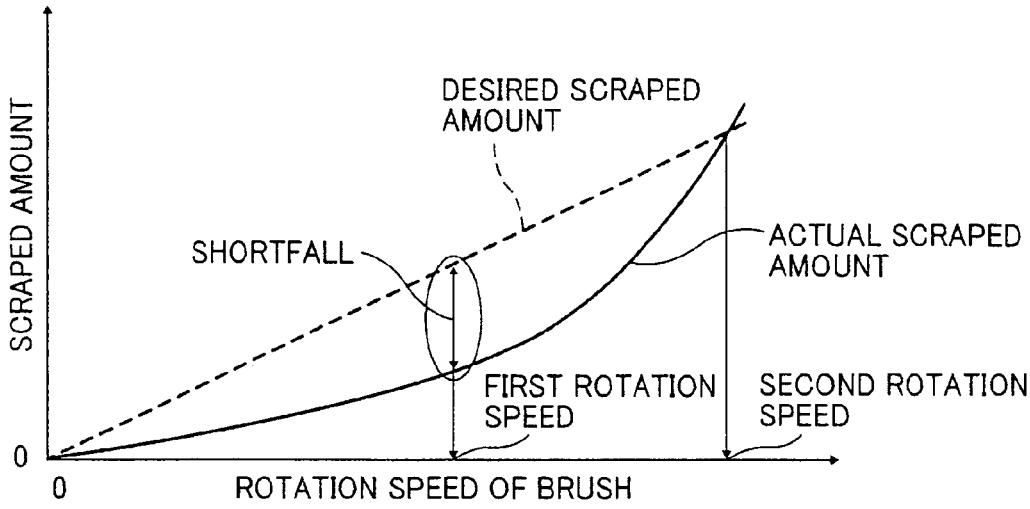
FIG. 6 is a graph illustrating a relation between a rotation speed of a brush roller and an amount of the solid lubricant scraped.

FIG. 6 is a graph illustrating a relation between the rotation speed of the brush roller and the amount scraped off the solid lubricant.

For example, when the rotation speed of the photoreceptor 3 is reduced by half, if the amount scraped off the solid lubricant 32 is reduced by half, there is no problem. However, actually, the scraped amount is reduced by more than half.

For example, in the case in which the brush roller 31 rotates at a first rotation speed 1 lower than the second rotation speed 2, even if a desired appropriate amount is obtained when the solid lubricant 32 is scraped off at a second rotation speed 2 of the photoreceptor, the amount scraped off the solid lubricant 32 decreases to be insufficient. This is because an impact force which the tips of the bristles of the brush roller 31 apply to the solid lubricant 32 decreases.

Therefore, when the rotation speed is low, since it is difficult to scrape the lubricant more than necessary, the applied amount onto the photoreceptor 3 decreases so that problems such as a cleaning error occur.

Figure 7:
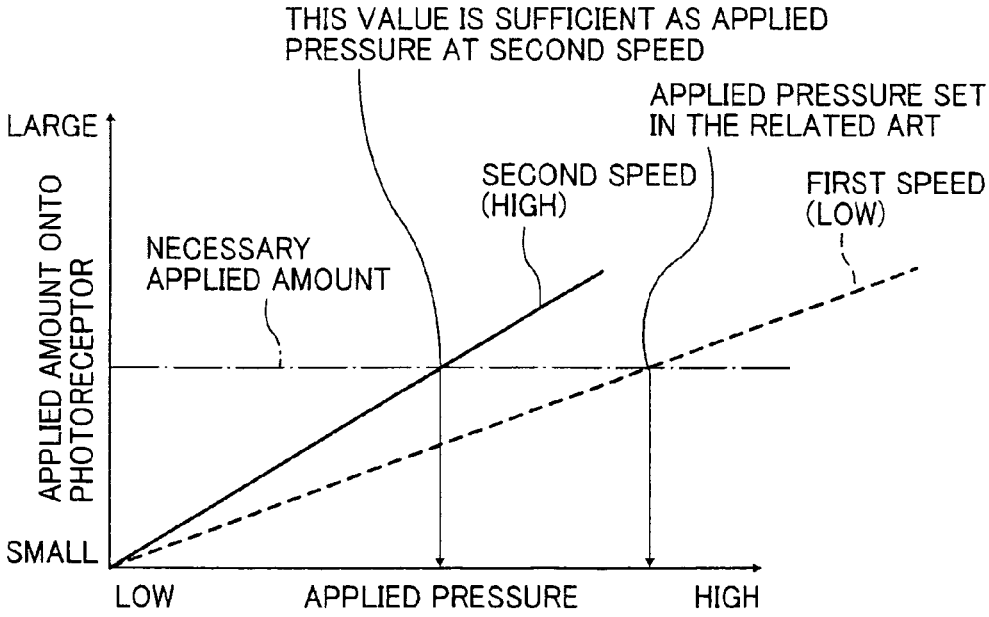
FIG. 7 is a graph illustrating a relation between an applied pressure to the solid lubricant and the amount of the solid lubricant scraped.

FIG. 7 is a graph illustrating a relation between an applied pressure to the solid lubricant and the amount scraped off the solid lubricant for each rotation speed of the brush roller.

Further, as illustrated in FIG. 7, for that reason, until now, the applied pressure to the solid lubricant 32, regardless of the rotation speeds or circumferential speeds of the photoreceptor 3 in individual image modes has been set such that the amount of lubricant applied onto the photoreceptor can be a desired amount when the linear speed of the photoreceptor 3 is lowest or the rotation speed of the photoreceptor 3 is lowest.

Therefore, in the case of an image mode using a linear speed of the photoreceptor 3 higher than the lowest linear speed, as illustrated in FIG. 7, actually, a sufficient applied amount of lubricant can be obtained with a relatively low application pressure.

However, in the simple configuration of the lubricant applying device 30 according to the related art, it may be impossible to change the applied pressure to the solid lubricant 32 in response to the linear speed of the brush roller 31. For this reason, in the case where the linear speed of the brush roller 31 is high, it is used in a state in which the applied amount of lubricant is large and wasteful lubricant exists, so that lifetime extension and space saving are interfered with.

In the simple configuration of the lubricant applying device 30 of the image forming apparatus 1 according to the embodiment of the present invention, by pressing the solid lubricant 32 with an approximate press even if the linear speed of the brush roller 31 could changes, it may be possible to apply an approximate amount of lubricant onto the photoreceptor 3 even when the linear speed of the brush roller 31 changes. Therefore, lifetime extension or space saving may be achieved.

Figure 8A:
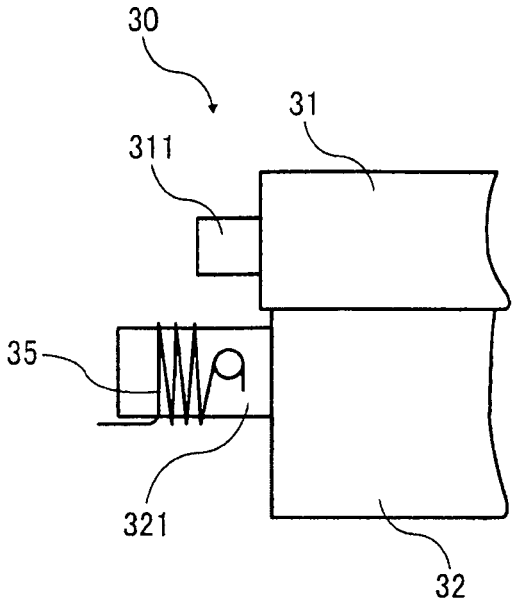
FIG. 8A is a plan view illustrating a configuration of a lubricant applying device provided to an image forming apparatus according to the present invention in the axial direction of a core bar of a brush roller.
Figure 8B:
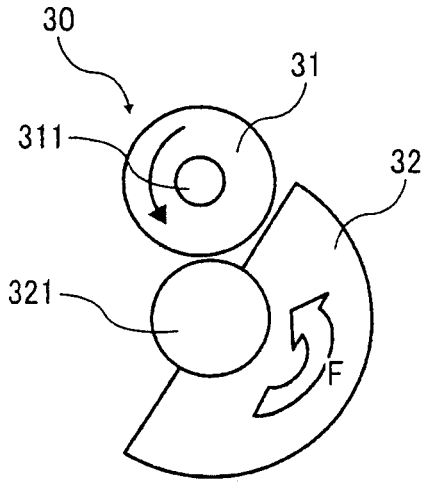
FIG. 8B is a side view illustrating the configuration of the lubricant applying device provided to the image forming apparatus according to the present invention in the axial direction of the core bar of the brush roller.

FIG. 8A is a plan view illustrating a configuration of a lubricant applying device provided to an image forming apparatus according to an embodiment of the present invention in the axial direction of a core bar of a brush roller, and FIG. 8B is a side view illustrating the configuration of the lubricant applying device provided to the image forming apparatus according to an embodiment of the present invention in the axial direction of the core bar of the brush roller.

As illustrated in FIGS. 8A and 8B, in the lubricant applying device 30 according to the embodiment of the present invention, the core bar passes through the solid lubricant 32 so as to improve the rigidity of the solid lubricant 32 in the longitudinal direction, and a torque is applied to the core bar 321 by a torsion coil spring 35 or the like, so that it may be possible to easily press the solid lubricant 32 against the brush roller 31 serving as the applying member with a force F exerted by the torsion coil spring 35. Since the rigidity improves, the solid lubricant 32 is scraped off uniformly in the longitudinal direction and the scraped lubricant uniformly adheres to the brush roller 31, so that the lubricant can be uniformly applied onto the photoreceptor 3.

The solid lubricant 32 including the core bar 321 is easily made by insert molding, and the recycle thereof is also easy. The recovered used core bar 321 is set into and molded in a mold. Since the lubricant remaining on the core bar is also melted during the molding, it is unnecessary to remove the lubricant remaining on the core bar.

Figure 9:
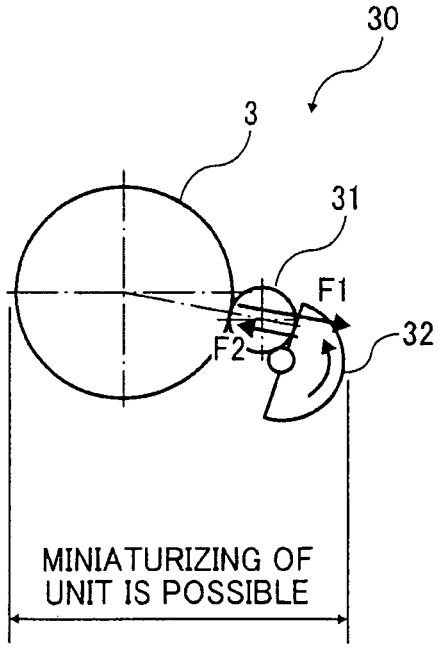
FIG. 9 is a view schematically illustrating exerting forces in the configuration of the lubricant applying device according to the present invention.

FIG. 9 is a sectional view schematically illustrating exerting forces in the configuration of the lubricant applying device according to the embodiment of the present invention.

As illustrated in FIG. 9, if the solid lubricant 32 is made in a manner such that the cross-section thereof has a substantially circular arc shape when a portion of a cylindrical shape of the solid lubricant 32 is cut out and such that the solid lubricant 32 is rotatable around the core bar 321 as a rotation center, when the solid lubricant 32 is disposed on an extended line connecting between the center of the photoreceptor 3 and the center of the brush roller 31, and the solid lubricant 32 is pressed against the brush roller 31 by the coil spring 35, so that a reaction force F2, which acts in a direction from the back of the solid lubricant 32 to the brush roller 31 in opposition to a reaction force F1 acting in a direction from the photoreceptor 3 to the brush roller 31, is applied to the solid lubricant 32 by the coil spring 35, the flexion of the brush roller 31 can be reduced to some extent. Therefore, since the brush roller 31 is in contact of certain nip with the photoreceptor 3, the brush roller 31 receives the reaction force from the photoreceptor 3. Further, the solid lubricant 32 is pressed on the brush roller 31 by the load of the spring or the like. With miniaturization, the size of the brush roller 31 is decreasing. Thus, the rigidity becomes inevitably insufficient, so that the brush roller 31 deforms. If the brush roller 31 deforms, since the contact of the brush roller 31 with the photoreceptor 3 becomes nonuniform, it may be impossible to uniformly apply the lubricant onto the photoreceptor 3. For this reason, it is possible to minimize the deformation of the brush roller 31 by making a force act in a direction of canceling the loads each other. In the case of using the above-mentioned configuration, when the solid lubricant 32 having the rectangular parallelepiped shape according to the related art is used, it is difficult to avoid an increase in the size of a unit. However, according to the embodiment of the present invention, it may be possible to achieve an arrangement of minimizing the deformation of the brush roller 31 and to ensure a more amount of lubricant. Therefore, in the case of using the solid lubricants 32 having the rectangular parallelepiped shape that have been used in the related art, the lubricant applying device 30 according to the embodiment of the present invention can be implemented in a size smaller than that of the lubricant applying device 30 according to the related art.

Figure 10A:
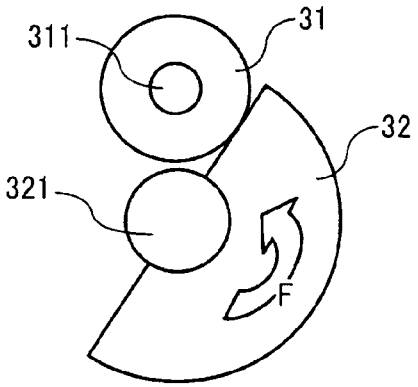
FIG. 10A to 10C are views illustrating shapes of the solid lubricant of the lubricant applying device according to the present invention.
Figure 10B:
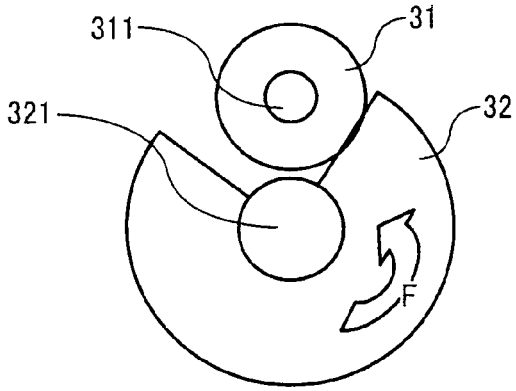
Figure 10C:
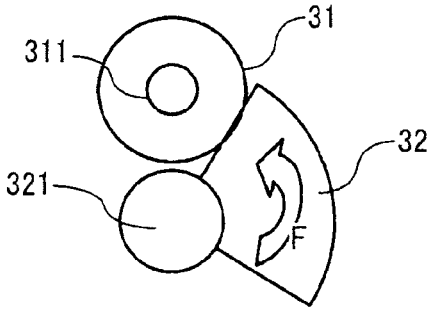

FIG. 10A to 10C are sectional views illustrating shapes of the solid lubricant of the lubricant applying device according to the embodiment of the present invention.

Each of the figures shows the shape that can be obtained by cutting out part of a cylindrical shape along the axial direction of the core bar 321. Viewing cross-section with respect to the axial direction, its shape is a substantially circular arc shape. The example illustrated in FIG. 9 uses the semi-circular solid lubricant 32. However, any one of the shapes as illustrated in FIG. 10A to 10C may be used. Therefore, even when the solid lubricant 32 has a shape as illustrated in FIG. 10B at an early stage, and is gradually consumed to be a shape as illustrated in FIG. 10C through a shape as illustrated in FIG. 10A, the solid lubricant 32 can be pressed against the brush roller 31 with the constant force F2 by the coil spring 35.

Figure 11:
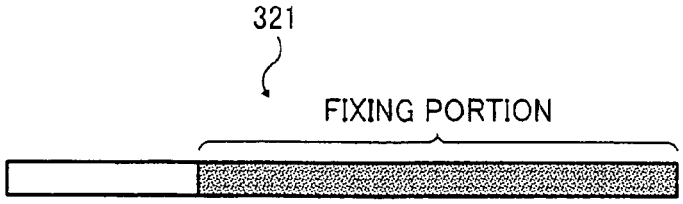
FIG. 11 is a view illustrating the structure of the core bar fixing the solid lubricant of the lubricant applying device according to the present invention.

FIG. 11 is a view illustrating a structure of the core bar fixing the solid lubricant of the lubricant applying device according to the embodiment of the present invention.

The core bar 321 fixing the solid lubricant 32 of the lubricant applying device 30 according to the embodiment of the present invention is provided with the uneveness in a portion where the solid lubricant 32 is fixed. The uneveness can be given by a drawing process or a knurling process. Further, knurling shapes as defined in JIS B 0951 have general-purpose properties in process and thus are preferable. However, even though the above-mentioned processing methods are not used, shapes with the uneveness in the circumferential direction of the core bar 321 may be used.

Since the uneveness exist in the circumferential direction of the core bar 321, it is possible to prevent the solid lubricant 32 from slipping from the core bar 321 when a torque is applied to press the solid lubricant 32 against the brush roller 31.

Since the core bar 321 and the lubricant are molded by the insert molding such that the solid lubricant 32 and the core bar 321 are firmly bonded, it is possible to prevent the solid lubricant 32 from slipping due to the torque of the core bar 321 and to suppress the lubricant applied onto the photoreceptor 3 from being uneven and nonuniform. Further, since it is unnecessary to use an adhesive or others in order to fix the core bar 321 and the solid lubricant 32, recycle is also easy.

Figure 12A:
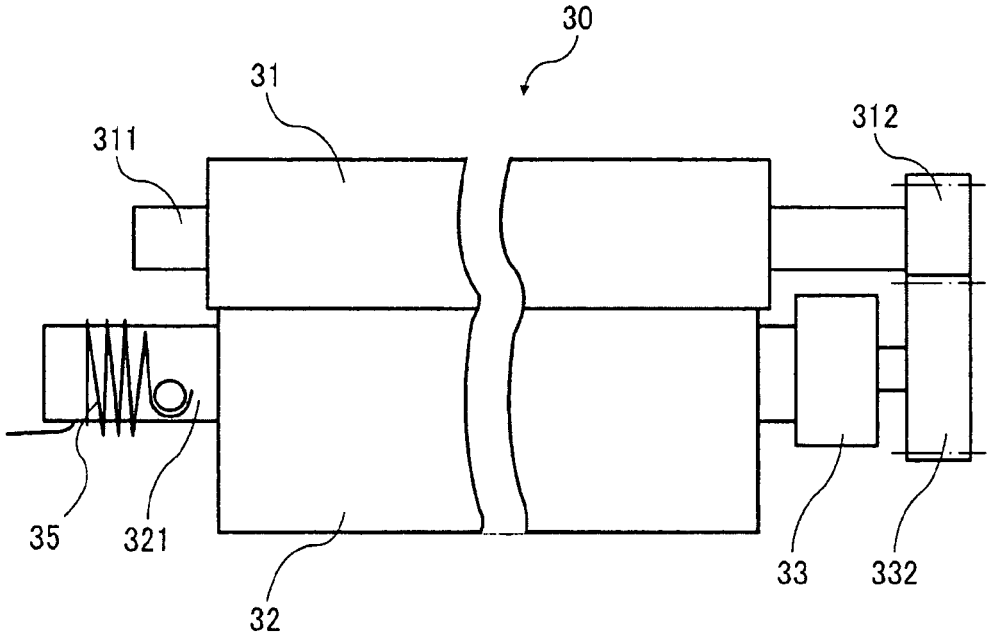
FIG. 12A is a plan view illustrating the configuration of the lubricant applying device according to the present invention in the axial direction of the core bar of the brush roller.
Figure 12B:
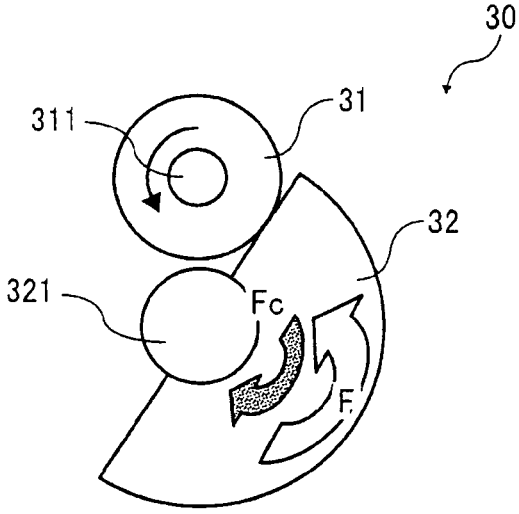
FIG. 12B is a side view illustrating the configuration of the lubricant applying device according to the present invention in the axial direction of the core bar of the brush roller.

FIG. 12A is a plan view illustrating the configuration of the lubricant applying device according to an embodiment of the present invention in the axial direction of the core bar of the brush roller, and FIG. 12B is a side view illustrating the configuration of the lubricant applying device according to an embodiment of the present invention in the axial direction of the core bar of the brush roller.

As illustrated in FIGS. 12A and 12B, the lubricant applying device 30 according to the embodiment of the present invention uses the solid lubricant 32 having a substantially circular arc shape and further includes a damping device (hereinafter, referred to as a 'damper') 33 installed to the core bar 321, and a brush gear 312 installed to a brush core bar 321 of the brush roller 31 is engaged with a damper gear 332.

Therefore, the applied pressure to the brush roller 31 by the solid lubricant 32 should reflect the force F exerted by the torsion coil spring 35 and a force Fc exerted by transmission of a driving force from the brush roller 31 generated by the damper 33 mounted on the core bar 321 of the solid lubricant 32. Here, as the damper 33, a rotary damper 33 is used.

Examples of the rotary damper are given in Japanese Patent No. 2581655 and Japanese Patent No. 2808118. The rotary damper performs a braking operation by meshing the gear on a gear, a rack, or the like installed to a slide holder or an openable and closable lid and damping a biasing force attributable to restoring of a return spring by using the viscosity resistance of grease filled in the damper. That is, an oil-type rotary damper brakes movement of a moving object by the viscosity resistance of grease or others filled in the damper. Therefore, a moving object or the like rotating on a shaft is biased in a predetermined direction by the return spring and vigorously moves or rotates in the opposite direction by restoring force of the return spring or the like.

Figure 13:
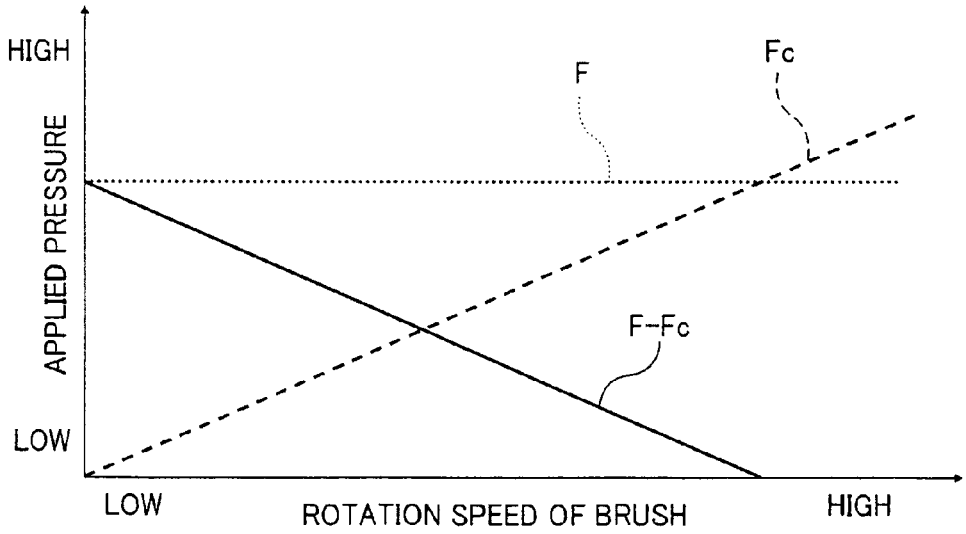
FIG. 13 is a graph illustrating a relation between the rotation speed of the brush roller and the applied pressure.

FIG. 13 is a graph illustrating a relation between the rotation speed of the brush roller and the applied pressure.

Here, a reference symbol F denotes force acting by the torsion coil spring 35, and a reference symbol Fc denotes force acting by the damper 33. The force Fc is generated according to the rotation speed and thus can be expressed as Fc=(Damping Coefficient C)×(Speed V). The solid lubricant 32 applies a load to the brush roller 31 by the torsion coil spring 35 or the like. The damper 33 is disposed in a manner such that when the brush roller 31 is at rest, the load is applied with only the force F, and when the brush roller 31 is rotating, the load is applied with F−Fc. Therefore, when the rotation speed of the brush roller 31 is high, the force F is large and the applied pressure to the brush roller 31 by the solid lubricant 32 is low. When the rotation speed of the brush roller 31 is low, the force Fc is small and thus the solid lubricant 32 can be pressed with a larger force so as to complement a reduction in scraping force due to the low rotation speed.

The torsion coil spring 35, regardless of the rotational angle of the core bar 321 of the solid lubricant 32, acts by a constant force F. However, the force Fc by the damper 33 is in proportion to the rotation speed as described above. Therefore, when the rotation speed of the brush roller 31 is high, the applied pressure to the solid lubricant 32 is large, and when the rotation speed of the brush roller 31 is low, the applied pressure to the solid lubricant 32 is small.

Therefore, as illustrated in FIG. 13, as the rotation speed of the brush roller 31 increases, the F−Fc decreases and thus the applied pressure to the brush roller 31 by the solid lubricant 32 is reduced.

In other words, the pressure applied to the brush roller 31 when the rotation speed of the solid lubricant 32 high is lower than the pressure applied to the solid lubricant 32 when the rotation speed of the brush roller 31 is low. Therefore, it may be possible to correct a reduction in scraping force due to a decrease in the rotation speed of the brush roller 31. The damping coefficient of the damper 33 may be determined on the basis of the correction amount of the scraped amount according to a change in the rotation speed.

Figure 14A:
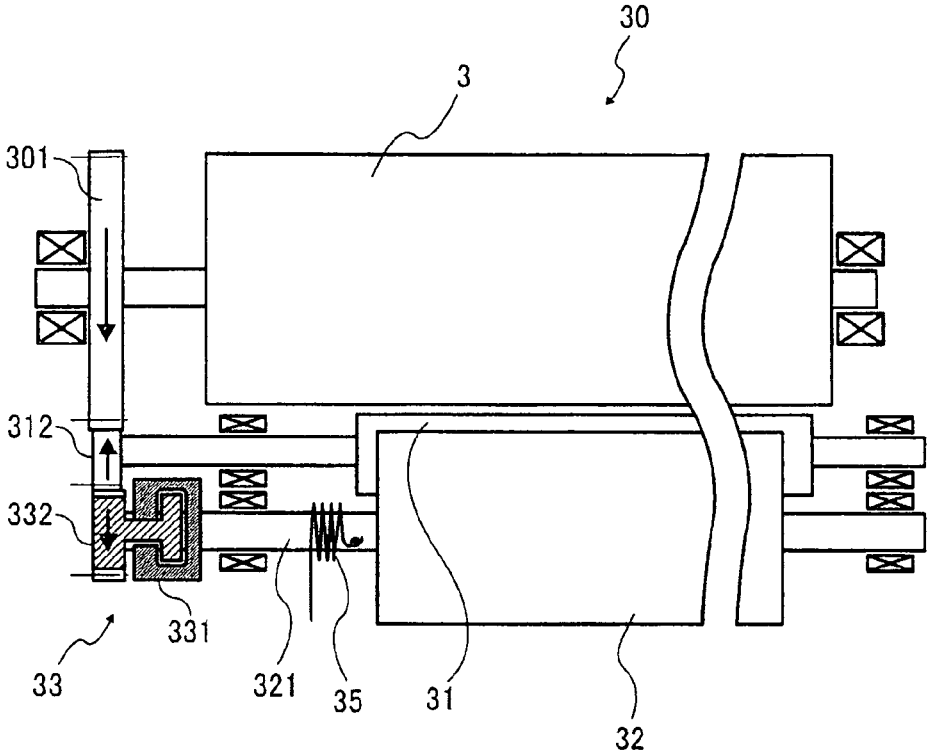
FIG. 14A is a plan view illustrating an operation of a lubricant applying device according to the present invention as seen from above in the axial direction of the core bar of the brush roller.
Figure 14B:
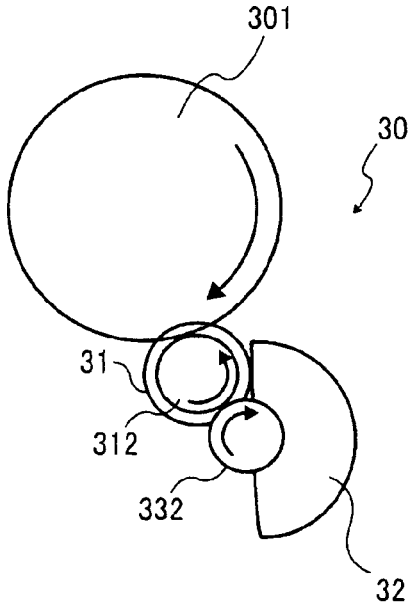
FIG. 14B is a side view illustrating the operation of the lubricant applying device according to the present invention in the axial direction of the core bar of the brush roller.

FIG. 14A is a plan view illustrating an operation of a lubricant applying device according to an embodiment of the present invention as seen from above in the axial direction of the core bar of the brush roller, and FIG. 14B is a side view illustrating the operation of the lubricant applying device according to the embodiment of the present invention in the axial direction of the core bar of the brush roller.

A concrete operation of the lubricant applying device 30 including a damping device (hereinafter, referred to as a 'damper') 33 installed to the core bar 321 will be described with reference to FIGS. 14A and 14B.

The brush gear 312 of the brush roller and the damper gear 332 are driven by a photoreceptor gear 301 integrated with the photoreceptor 3 by press fitting.

As illustrated in FIGS. 14A and 14B, the damper 33 is divided into the damper gear 332 which is an input side and a damper case 331 which is an output side. The damper case 331 is filled with a liquid such as silicon oil or the like, and a paddle plate operates in the liquid in synchronization with the operation of the damper gear 332 so as to generate a force according to a damping force based on the drag of the liquid. When the damper case 331 is fixed and the damper gear 332 side rotates, a damping force proportional to the speed of the damper gear 332 side is applied to the damper case 331 side in the rotation direction of the damper gear 332. Further, when the damper case 331 is fixed to the solid lubricant 32 or the core bar 321, the damping force according to the rotation of the damper gear 332 side is transmitted to the solid lubricant 32.

Since the rotation of the damper gear 332 is in synchronization with the movements of the photoreceptor 3 and the brush roller 31, the force by the damper 33 varies according to the speed of the brush roller 31. Specifically, when the rotation speed of the brush roller 31 is low, the force by the damper 33 is small, and when the rotation speed of the brush roller 31 is high, the force by the damper 33 is larger than the case.

When the rotation direction of the damper gear 332 is set as illustrated in FIGS. 14A and 14B, the force by the damper 33 is applied in a direction of the solid lubricant 32 away from the brush roller 31.

Here, the torsion coil spring 35 applies a force to the solid lubricant 32 in advance in a direction of the solid lubricant 32 closer to the brush roller 31.

One end of the torsion coil spring 35 is fixed to a non-rotating member such as a frame of the photoreceptor 3 by hooking or the like, and the other end thereof is fixed to the core bar 321 or others synchronized with the movement of the solid lubricant 32 by hooking or the like. Therefore, when the photoreceptor 3 does not rotate, the damper gear 332 side of the damper 33 does not rotate (the speed is 0). As a result, the force by the damper 33 (=(Damping Coefficient)×(Speed)) is '0', and the force of only the torsion coil spring 35 to the brush roller 31 is applied to the solid lubricant 32.

In other words, when the damper 33 is disposed in the direction as illustrated in FIGS. 14A and 14B, the applied pressure to the solid lubricant 32 is obtained by subtracting the force by the damper 33 according to the rotation speed of the brush roller 31 from the force of the torsion coil spring 35 as illustrated in FIG. 13. Accordingly, as illustrated in FIGS. 6 and 7, the application amount of the solid lubricant 32 onto the photoreceptor 3 varying according to the rotation speed of the brush roller 31 can be made uniform by controlling the damping force of the damper 33 to an appropriate value.

In FIGS. 14A and 14B, the brush roller 31 and the photoreceptor 3 rotate in the forward direction so that the rotation directions of them are the same course as each other at the contact portion, but may rotate in the backward direction. However, a positional relation must be maintained in which the rotation of the damper 33 is the same direction as the rotation of the photoreceptor 3.

Further, in FIGS. 14A and 14B, on only one side of the core bar 321 in the axial direction of the solid lubricant 32, the damper 33 is mounted. However, on both sides of the core bar 321, dampers may be mounted. It is also possible to mount the torsion coil springs 35 and the dampers 33 on the both sides of the core bar 321.

The driving force for the damper 33 is input from the damper gear 332 side. However, the driving force for the damper 33 may be input from the damper case 331 side, and the damper gear 332 side may be connected to the solid lubricant 32. Further, the damper gear 332 of the damper 33 is not necessarily required, but any configuration capable of transmitting the driving force to the damper 33 may be adopted.

The gear train is illustrated as an example, and if the operation direction of the damper 33 by rotation is set to be the intended direction, the number and disposition of gears are not necessarily limited to the example illustrated in FIGS. 14A and 14B.

In FIGS. 14A and 14B, the brush roller 31 or the damper 33 receives the driving from the photoreceptor 3. However, the brush roller 31 or the damper 33 may be driven in other manners.

Here, in order to make the application amount of lubricant always uniform, as the rotation speed of the brush roller 31 decreases, the applied pressure to the solid lubricant 32 increases. In order to increase the applied amount of lubricant as the linear speed increases, any configuration capable of driving the damper 33 in the opposite manner may be adopted, so that it may be possible to increase the applied pressure to the lubricant as the rotation speed increases.

In this case, since the torsion coil spring 35 is not necessarily required, a force may be set to be applied in the opposite direction.

Although the embodiment using the solid lubricant 32 having a substantially circular arc shape has been described above, the embodiment may apply to the solid lubricant 32 having a rectangular parallelepiped shape generally used.

Figure 15A:
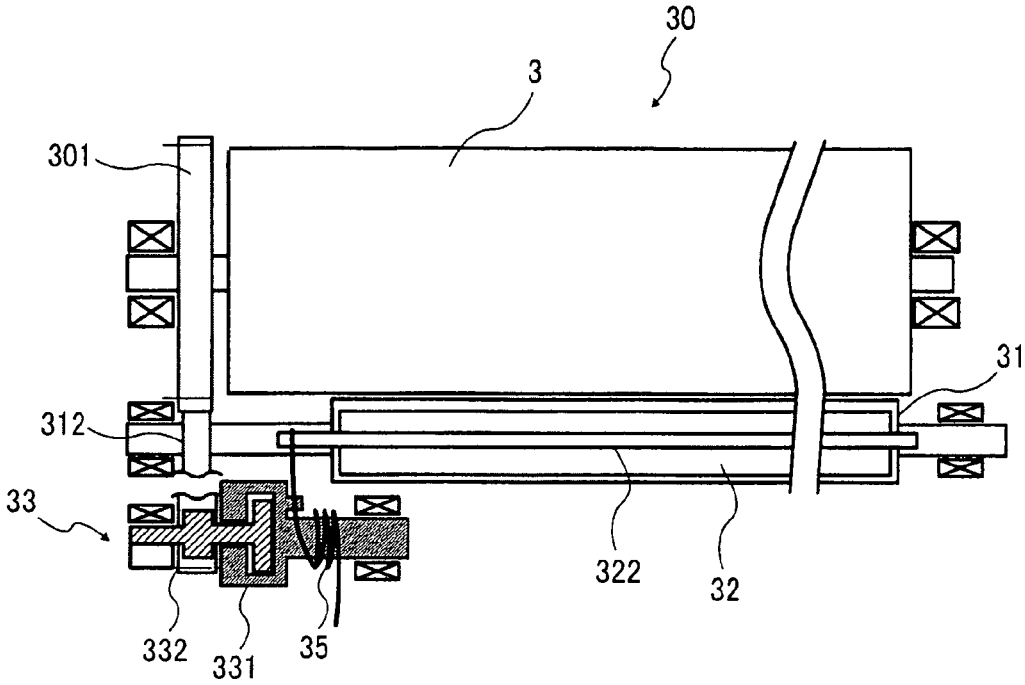
FIG. 15A is a plan view illustrating an operation of a lubricant applying device according to the present invention as seen from above in the axial direction of the core bar of the brush roller.
Figure 15B:
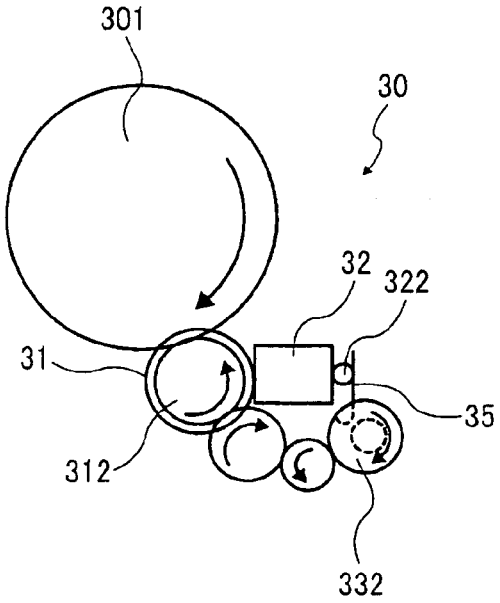
FIG. 15B is a side view illustrating the operation of the lubricant applying device according to the present invention in the axial direction of the core bar of the brush roller.

FIG. 15A is a plan view illustrating an operation of the lubricant applying device according to the embodiment of the present invention, which is viewed from above in the axial direction of the core bar of the brush roller, and FIG. 15B is a side view illustrating the operation of the lubricant applying device according to the embodiment of the present invention, which is viewed in the axial direction of the core bar of the brush roller.

Similarly, the damper 33 transmits the driving force from the photoreceptor 3 and the brush roller 31 to the damper gear 332 side, and the force by the damper 33 varies according to the speed.

The torsion coil spring 35 is hooked on a pressing member 322 at one end thereof to press the end portion of the solid lubricant 32 having the rectangular parallelepiped shape so that the a force may act in a direction to bring the solid lubricant 32 into contact with the brush roller 31. The force by the damper 33 is applied to one end side of the torsion coil spring 35 being in contact with the solid lubricant 32. Therefore, the applied pressure can vary according to the rotation speed of the brush roller 31.

Figure 16:
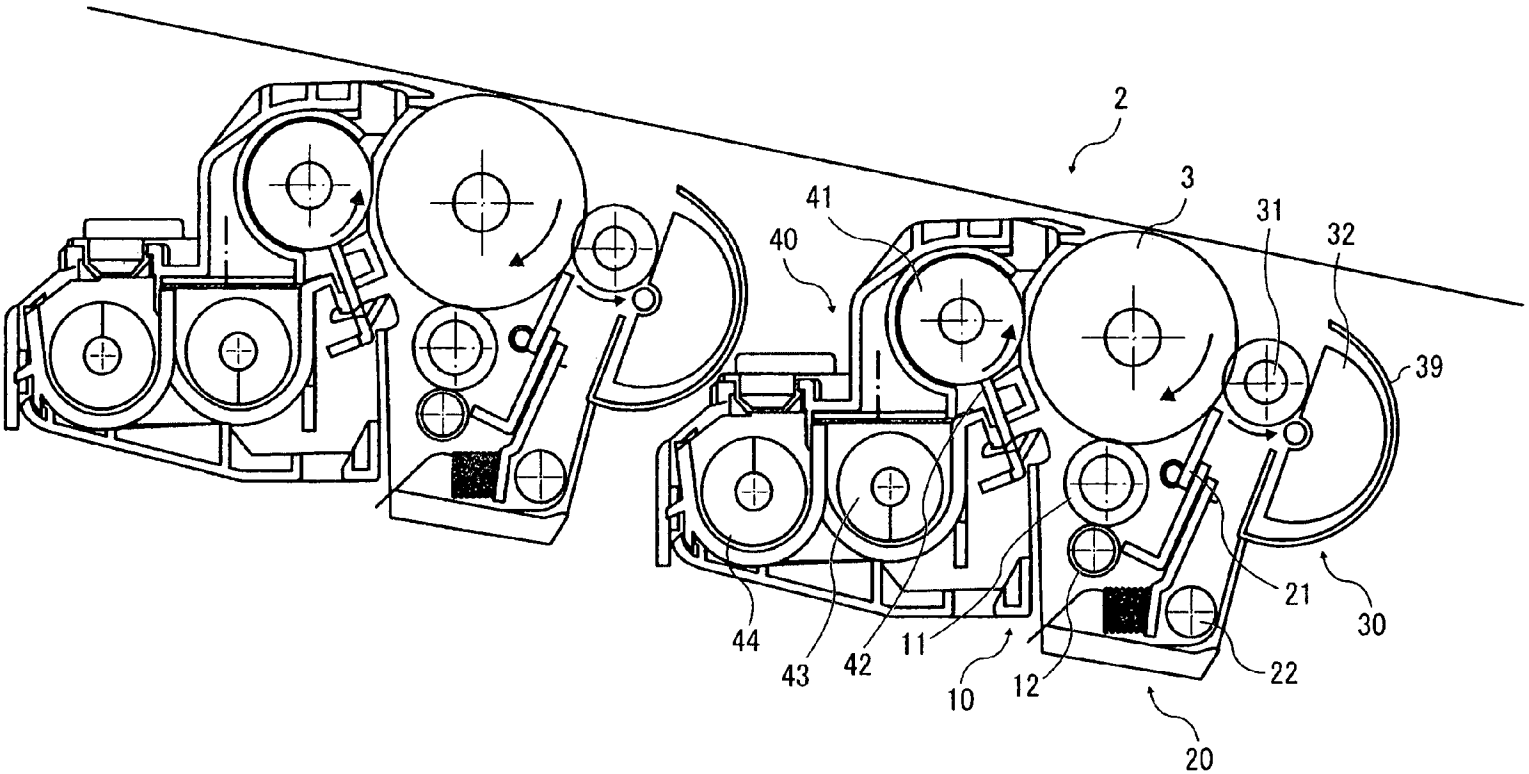
FIG. 16 is a view illustrating a portion of an image forming apparatus in which process cartridges equipped with solid lubricants according to the present invention are arranged in parallel.

FIG. 16 is a view illustrating a portion of an image forming apparatus including process cartridges which have solid lubricants and are arranged in parallel according to an embodiment of the present invention.

In the case of a tandem-type image forming apparatus, a photoreceptor unit is close to a neighboring color photoreceptor unit and thus the volume of the solid lubricant is restricted. However, if use is made of the circular arc shaped solid lubricant 32 according to the embodiment of the present invention, it may be possible to use a dead space which has not been used or a place which could not be used in the case of using the lubricant having the rectangular parallelepiped shape. Accordingly, a larger amount of the solid lubricants 32 can be mounted.

Since the dead space which has not been used in the case of using the lubricant having the rectangular parallelepiped shape can be used, it may be possible to increase the amount of lubricant. Further, the applied pressure can be adjusted, so that the force scraping lubricant off the solid lubricant 32 is prevented from being reduced due to a decrease in the rotation speed of the brush roller 31 and the scraping force can be set to an appropriate value.

Moreover, in the lubricant applying device 30 according to the embodiment of the present invention, as illustrated in FIG. 16, both ends of the core bar 321 are rotatably fixed and a torque is applied to the core bar 321 to press it against the brush roller 31. Therefore, there is no contact portion of the lubricant applying device 30 other than the brush roller 31, and thus clipping or cracks do not occur, thereby generating no fragments which may enter the process cartridge 2 to be a cause of damage or abnormal image generation and generating no crack portions which may degrade the application performance to cause an application error resulting in an abnormal image.

Next, an operation of the image forming apparatus according to the embodiment of the present invention will be described with reference to FIG. 1.

In an image forming operation, first, electrostatic latent images for individual colors are formed on the surfaces of the photoreceptors 3 having a negative charge polarity by laser beams of the exposing device 4. Next, in the developing device 40, reversal development is performed by developing the latent images with predetermined color toners having the same polarity (negative polarity) as charging polarity of the photoreceptors 3, thereby obtaining developed images. In this case, the endless intermediate transfer belt 51 is stretched and supported by the plurality of rollers 531, 532, 533, and 534, is provided on the photoreceptors 3Y, 3C, 3M, and 3K, and runs so as to be brought into contact with portions of the individual photoreceptors 3Y, 3C, 3M, and 3K after the development process. Further, the toner images formed on the photoreceptors 3Y, 3C, 3M, 3K are transferred onto the intermediate transfer belt 51 by primary transfer rollers 52Y, 52C, 52M, and 52K so that the toner images overlap one another to form an unfixed image. On the outer circumference of the intermediate transfer belt 51, the intermediate transfer belt cleaning device 55 is provided at a position facing a cleaning backup roller 655. The intermediate transfer belt cleaning device 55 wipes unnecessary remaining toner or foreign substances such as paper powder from the surface of the intermediate transfer belt 51.

Further, on the outer circumference of the intermediate transfer belt 51, the secondary transfer roller 54 is provided at a position facing the support roller 532. When a bias voltage is applied to the secondary transfer roller 54 while the recording member 9 passes between the intermediate transfer belt 51 and the secondary transfer roller 54, the toner image carried by the intermediate transfer belt 51 is transferred to the recording member 9. The polarity of a transfer voltage applied to the secondary transfer roller 54 is the positive polarity opposite to the polarity of the toner. The members associated with the intermediate transfer belt 51 are integrally formed together with the intermediate transfer belt 51 to constitute the transfer device 50 attachable to and detachable from the image forming apparatus 1.

In the image forming apparatus 1, as illustrated in FIGS. 1 and 2, after the toner images on the photoreceptors 3Y, 3C, 3M, and 3K are transferred to the intermediate transfer belt 51, the lubricant is scraped off the solid lubricant 32 and is applied onto the photoreceptors 3 by the rotating brush roller 31. Then, the cleaning blade 21 of the cleaning device 20 cleans the toner remaining after the transfer and makes the lubricant on the photoreceptors 3 uniform at the same time. Next, the cleaning blade 21 returns to the position in the charging device 10, and the next image forming operation starts.

Further, on the lower side of the image forming apparatus 1, there is disposed the feeding device 60 including a feeding cassette 81 storing the recording members 9 in a manner of enabling to supply the recording members 9. Only one sheet of the recording members 9 is accurately sent from the feeding cassette 81 to resist rollers 63 by a conveying roller 62. Furthermore, the recording member 9 having passed the secondary transfer roller 54 is conveyed to the fixing device 70 provided on the downstream side in the conveying direction. The recording member 9 that was subjected to fixing is discharged to the discharge tray provided on the outside of the image forming apparatus 1 by discharging rollers 93 and comes to be stacked in the discharge tray.

The lubricant applying device according to an aspect of the present invention may control the scraped amount of lubricant by adjusting the applied amount of the lubricant depending on the rotation speed of the brush roller to an appropriate value without requiring an extensive device such as an additional driver for the brush roller. Therefore, it is possible to extend the lifetime of the solid lubricant.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A lubricant applying device comprising:

a solid lubricant;

a rotatable applying member scraping lubricant off the solid lubricant and applying the scraped lubricant onto a lubricant application target; and a pressing unit configured to press the solid lubricant against the applying member at an applied pressure, the pressing unit including a damping device configured to generate a damping force that resists advancement of the solid lubricant toward the applying member, the damping force being a frictional force that varies the applying pressure in accordance with a rotation speed of the applying member such that the applying pressure decreases as the rotation speed of the applying member increases.

2. The lubricant applying device according to claim 1, wherein the damping force of the damping device operates in conjunction with driving of the applying member.

3. The lubricant applying device according to claim 1, wherein a shape of the solid lubricant is substantially a three dimensional half-cylindrical shape.

4. The lubricant applying device according to claim 1, wherein the solid lubricant includes a solid lubricant core bar disposed substantially at the center of the solid lubricant, and wherein a solid lubricant material is affixed to the core bar.

5. The lubricant applying device according to claim 4, wherein the solid lubricant core bar is configured to receive a rotational torque, the rotational torque pressing the solid lubricant material against the applying member, the solid lubricant core bar including a solid lubricant fixing portion provided to have surface roughness.

6. The lubricant applying device according to claim 1, wherein a contact position between the solid lubricant and the applying member is disposed on the opposite side of an image carrier on a substantially linear line connecting the centers of the image carrier and the applying member.

7. The lubricant applying device according to claim 1, wherein the solid lubricant is made of zinc stearate.

8. A process cartridge comprising:

at least an image carrier carrying a latent image; and one or more units which are selected from the group consisting of a charging unit uniformly charging the surface of the image carrier, a developing unit supplying a toner to an electrostatic latent image formed on the surface of the image carrier to obtain a visible image, and a cleaning unit cleaning the surface of the image carrier, wherein the process cartridge is integrally supported and integrally attachable to and detachable from an image forming apparatus, the process cartridge includes a lubricant applying device, the lubricant applying device including, a solid lubricant;

a rotatable applying member scraping lubricant off the solid lubricant and applying the scraped lubricant onto a lubricant application target, and a pressing unit configured to press the solid lubricant against the applying member at an applied pressure, the pressing unit including a dampening damping device configured to generate a damping force that resists advancement of the solid lubricant toward the applying member, the damping force being a frictional force that varies the applying pressure in accordance with a rotation speed of the applying member such that the applying pressure decreases as the rotation speed of the applying member increases.

9. An image forming apparatus comprising:

an image carrier carrying a latent image;

a charging device charging the image carrier;

an exposing device exposing the image carrier to form an electrostatic latent image on the image carrier;

a developing device forming a toner image on the image carrier;

a transfer device transferring the toner image onto a recording medium directly or through an intermediate transfer medium;

a cleaning device removing a toner remaining on the image carrier after the transfer; and a lubricant applying device including, a solid lubricant, a rotatable applying member scraping lubricant off the solid lubricant and applying the scraped lubricant onto a lubricant application target, and a pressing unit configured to press the solid lubricant against the applying member at an applied pressure, the pressing unit including a damping device configured to generate a damping force that resists advancement of the solid lubricant toward the applying member, the damping force being a frictional force that varies the applying pressure in accordance with a rotation speed of the applying member such that the applying pressure decreases as the rotation speed of the applying member increases.

10. The lubricant applying device of claim 1, wherein the damping device generates the frictional force based on a drag of a liquid contained within the damping device.

11. The process cartridge of claim 8, wherein the damping device generates the frictional force based on a drag of a liquid contained within the damping device.

12. The image forming apparatus of claim 9, wherein the damping device generates the frictional force based on a drag of a liquid contained within the damping device.

* * * * *